US011390402B2

(12) United States Patent
Towne et al.

(10) Patent No.: US 11,390,402 B2
(45) Date of Patent: Jul. 19, 2022

(54) VACUUM APPARATUS FOR FILLING BULK CONTAINERS

(71) Applicant: TMT Vacuum Fillers, LLC, Danville, IL (US)

(72) Inventors: Clinton Scott Towne, Danville, IL (US); Randall L. Williamson, Danville, IL (US); Brock A. Gale, Danville, IL (US)

(73) Assignee: TMT Vacuum Fillers, LLC, Danville, IL (US)

( * ) Notice: Subject to any disclaimer, the term of this patent is extended or adjusted under 35 U.S.C. 154(b) by 0 days.

(21) Appl. No.: 16/789,513

(22) Filed: Feb. 13, 2020

(65) Prior Publication Data

US 2020/0180794 A1 Jun. 11, 2020

Related U.S. Application Data

(63) Continuation of application No. PCT/US2018/047529, filed on Aug. 22, 2018.

(60) Provisional application No. 62/548,717, filed on Aug. 22, 2017.

(51) Int. Cl.
*B65B 1/16* (2006.01)
*B65B 1/26* (2006.01)
(Continued)

(52) U.S. Cl.
CPC ..... *B65B 1/16* (2013.01); *B65B 1/06* (2013.01); *B65B 1/26* (2013.01); *B65B 1/28* (2013.01);
(Continued)

(58) Field of Classification Search
CPC .... B65B 1/06; B65B 1/16; B65B 1/18; B65B 1/26; B65B 1/28; B65B 31/02;
(Continued)

(56) References Cited

U.S. PATENT DOCUMENTS 2,609,134 A * 9/1952 Korber ..... B65B 31/024 53/512
2,720,375 A 10/1955 Carter
(Continued)

FOREIGN PATENT DOCUMENTS

JP 2008-023296 A 2/2008

OTHER PUBLICATIONS

Written Opinion and Search Report from PCT application No. PCT/US2018/047529 dated Aug. 22, 2018.
(Continued)

*Primary Examiner* — Stephen F. Gerrity
(74) *Attorney, Agent, or Firm* — Woodard, Emhardt, Henry, Reeves & Wagner, LLP

(57) ABSTRACT

A bulk container vacuum filing system includes a base portion and movable portion. The bulk container vacuum filing system serves to position and maintain a bulk container within a chamber, seal the interior of the chamber, dispense material into the bulk container, and draw a vacuum or create positive pressure within the chamber and/or the bulk container during at least a portion of the dispensing process. Base portion of the bulk container vacuum filing system includes a vacuum source and a material supply line along with electronic controls and sensors for operating and monitoring the filing process. The moveable portion include a support structure for supporting the bulk container, such as a bulk bag, in the proper place.

10 Claims, 6 Drawing Sheets

(51) Int. Cl.

| | |
|---|---|
| ***B65B 31/04*** | (2006.01) |
| ***B65B 57/06*** | (2006.01) |
| ***B65B 57/14*** | (2006.01) |
| ***B65B 57/18*** | (2006.01) |
| ***B65B 31/02*** | (2006.01) |
| ***B65B 1/28*** | (2006.01) |
| ***B65B 1/32*** | (2006.01) |
| ***B65B 1/06*** | (2006.01) |

(52) U.S. Cl.
CPC ..... *B65B 1/32* (2013.01); *B65B 31/024* (2013.01); *B65B 31/042* (2013.01); *B65B 57/06* (2013.01); *B65B 57/145* (2013.01); *B65B 57/18* (2013.01)

(58) Field of Classification Search
CPC ... B65B 31/024; B65B 31/042; B65B 31/044; B65B 43/54
USPC ..... 53/512; 141/67, 252
See application file for complete search history.

(56) References Cited

U.S. PATENT DOCUMENTS

| | | | | |
|---|---|---|---|---|
| 2,783,786 | A | 3/1957 | Carter | |
| 2,799,465 | A * | 7/1957 | Carter | B65B 1/18 141/10 |
| 3,928,940 | A | 12/1975 | Fagniart | |
| 4,872,493 | A | 10/1989 | Everman | |
| 4,922,686 | A | 5/1990 | Segota | |
| 5,109,893 | A | 5/1992 | Derby | |
| 5,279,339 | A * | 1/1994 | Derby | B65B 1/26 141/59 |
| 5,402,918 | A * | 4/1995 | Nishiyama et al. | B65B 1/16 222/152 |
| 5,573,044 | A * | 11/1996 | Mechalas | B65B 1/18 141/10 |
| 5,682,929 | A | 11/1997 | Maginot et al. | |
| 6,860,301 | B2 * | 3/2005 | Schaffer et al. | B65B 1/28 141/252 |
| 7,231,947 | B2 | 6/2007 | Boroch et al. | |
| 7,267,144 | B2 * | 9/2007 | Nyhof et al. | B65B 43/54 141/114 |
| 2006/0283149 | A1 * | 12/2006 | Passini | B65B 31/06 53/512 |
| 2009/0229703 | A1 | 9/2009 | Purnhagen et al. | |
| 2010/0012220 | A1 | 1/2010 | Waldron et al. | |

OTHER PUBLICATIONS

Supplemental Partial Search Report, related EP application No. EP18849358, dated Apr. 23, 2021, 17 pages.

* cited by examiner

VACUUM APPARATUS FOR FILLING BULK CONTAINERS

CROSS REFERENCE TO RELATED APPLICATIONS

This application is a continuation of International Patent Application No. PCT/US2018/047529 filed Aug. 22, 2018 which claims the benefit of U.S. Provisional Patent Application Ser. No. 62/548,717 filed Aug. 22, 2017 entitled "VACUUM APPARATUS FOR FILLING BULK CONTAINERS" which is hereby incorporated by reference in its entirety to the extent not inconsistent.

FIELD OF THE INVENTION

The present invention relates generally to the filling of bags with material and more particularly pertains to an apparatus and method for vacuum filling bulk containers with material.

DESCRIPTION OF THE ILLUSTRATED EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles being contemplated as would normally occur to one skilled in the art to which the invention relates.

Figure 1:
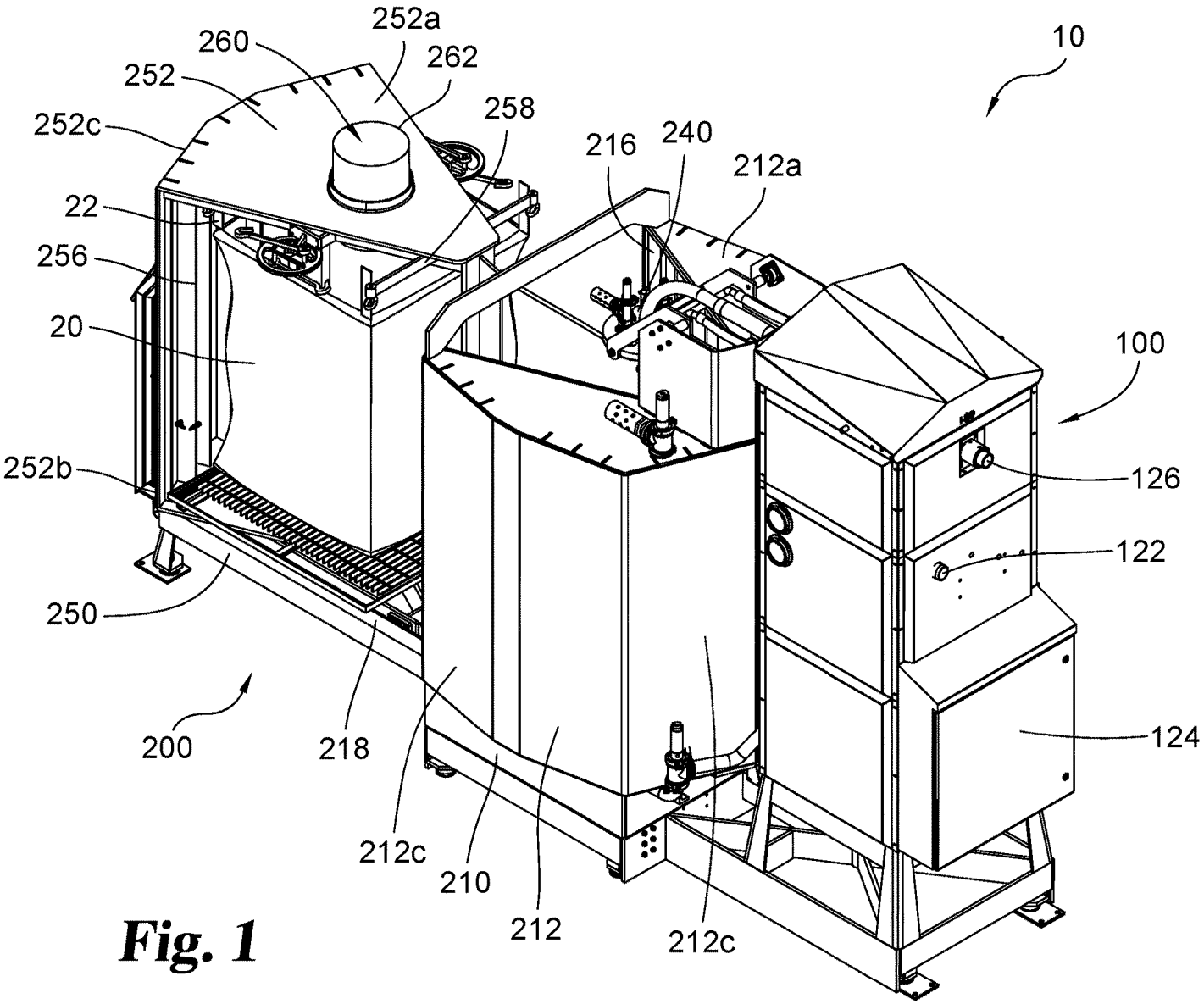
FIG. 1 is a front perspective view of a bulk container vacuum filling apparatus according to an embodiment of the present disclosure.
Figure 2:
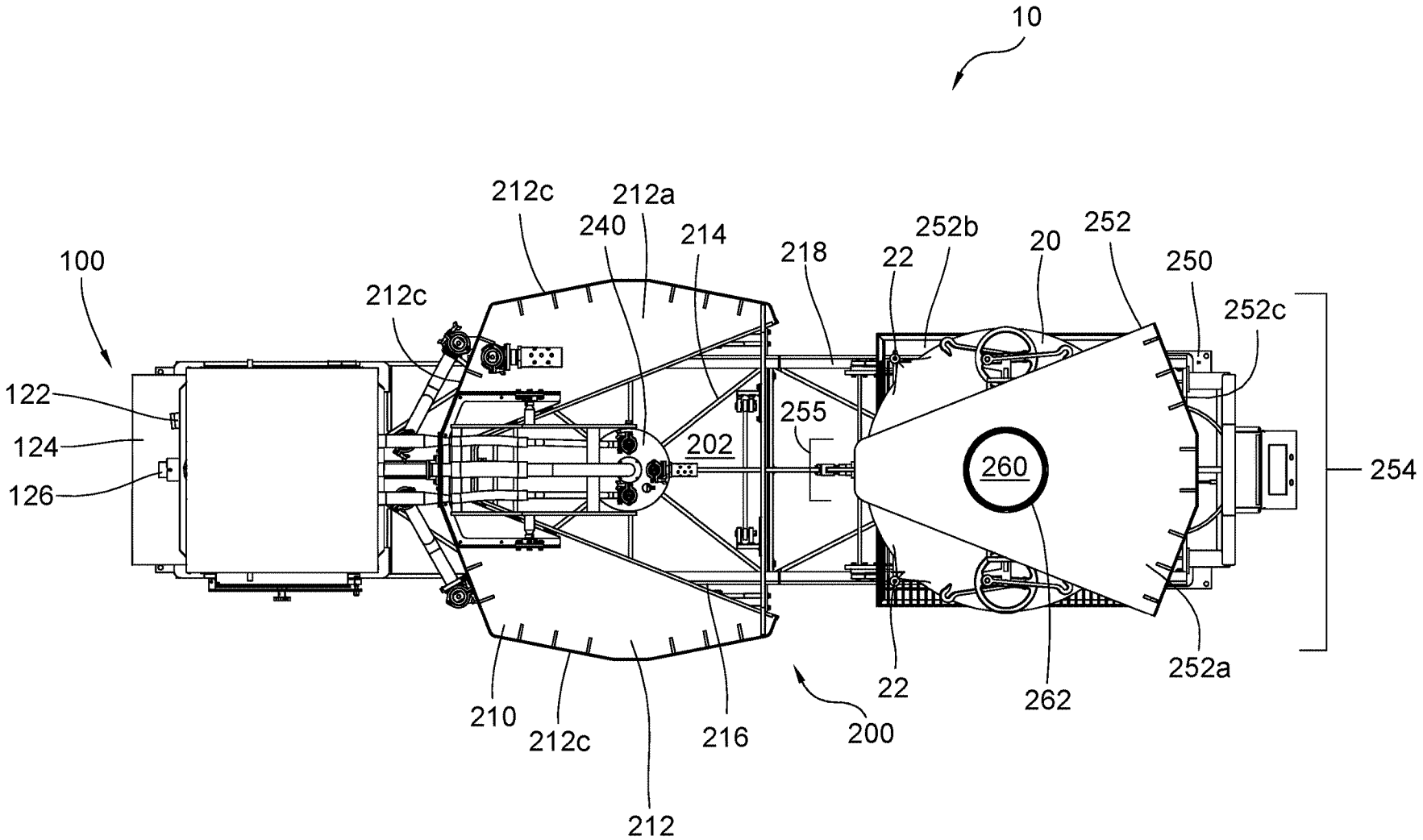
FIG. 2 is a top plan view of the bulk container vacuum filling apparatus of FIG. 1.
Figure 3:
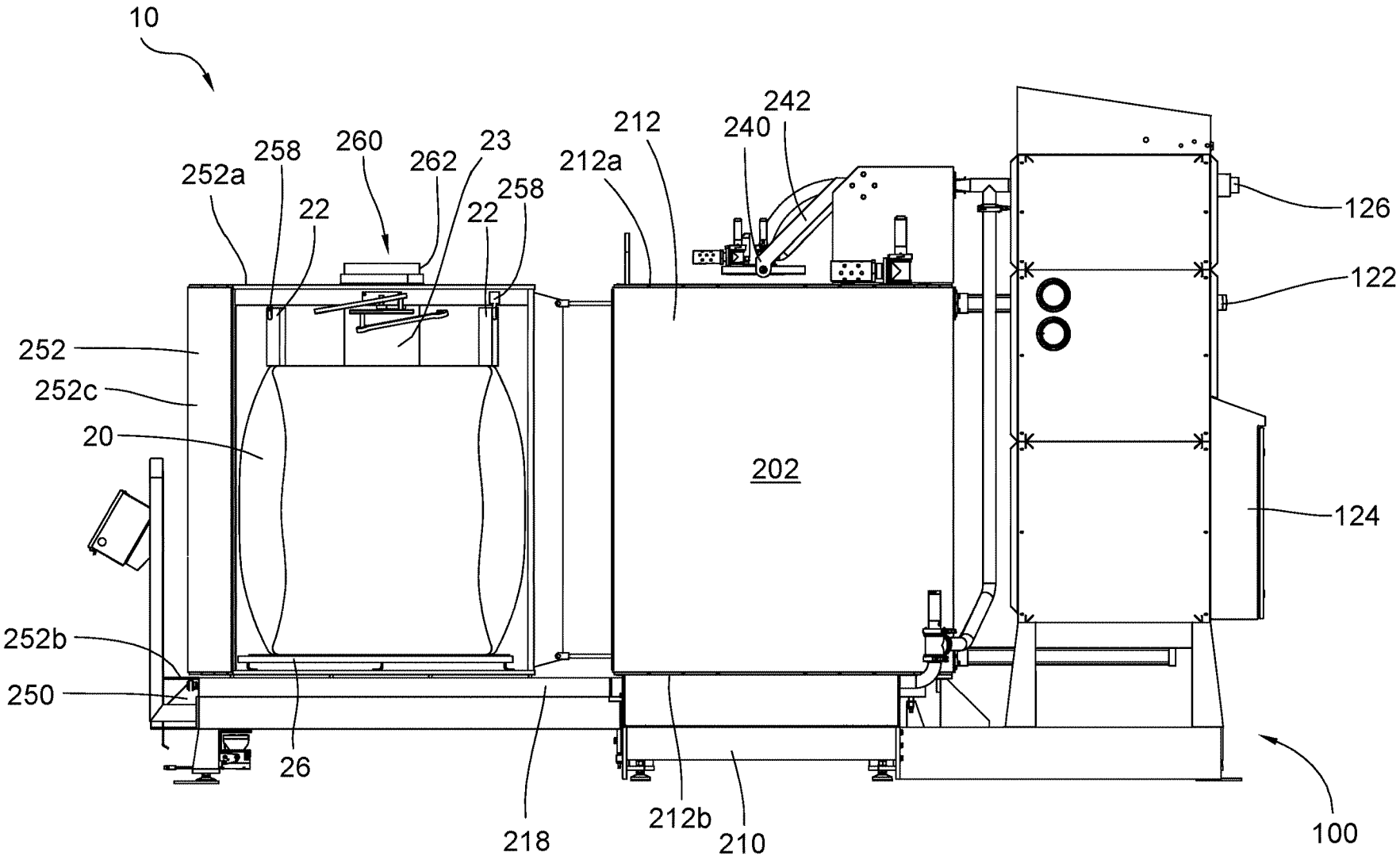
FIG. 3 is a side plan view of the bulk container vacuum filling apparatus of FIG. 1.

FIGS. 1-3 illustrate one embodiment of a bulk container vacuum filling apparatus 10. The apparatus includes a vacuum filling unit 100 and a bag placer assembly 200 which work in combination to fill a bulk container with a desired material.

The desired material may be any material which is traditionally stored within a bag or container. Typically, the materials for which vacuum filling is used are refined materials. For example, fine powders and shaped particles are particularly well suited to vacuum filling as augers can disperse them into the air and/or damage their shape. For purposes on non-limiting example, materials which are particularly suitable for vacuum filling include silicas, carbon black, stearates, fibers (including ceramic and acrylic fibers), dried collagens, talc and powdered lead. In addition, vacuum filling can achieve a higher density within the desired container in a shorter period of time. In addition to time savings, this increased density can provide for enhanced stability and reduced space during shipment.

Vacuum filling unit 100 may be in the form of a vertical tower as shown in FIGS. 1-3 and may include, among other components, the control logic for operating the bag placer assembly 200. For a description of the various components that may be included within vacuum filling unit 100, please refer to U.S. Pat. No. 4,351,373 entitled "System and Method for Filling Bag With Dry Powder" and U.S. Pat. No. 4,648,432 entitled "Vacuum Apparatus for Filling Bags With Particulate Material Including Dust Collector and Recycling of Collected Materials" the contents of each are hereby incorporated by reference to the extent not inconsistent.

In the illustrated embodiment, vacuum filling unit 100 includes connections to one or more of a vacuum source 122, a pressurized air source (not shown), electrical power 124, and a supply line for the material desired to be filled 126. Vacuum filling unit also includes control lines and feedback lines (not shown) for interfacing with bag placer assembly 200. Other connections, such as hydraulic lines, water lines or the like (not shown) may be included depending upon the desired configuration of vacuum filling unit 100 and the desired actuation of bag placer assembly 200.

The bag placer assembly 200 of FIGS. 1-3 is shown in one form which is sized so as to accommodate a flexible intermediate bulk container 20 (FIBC) (also known as a "bulk bag"). Bulk bag 20 is a widely utilized industrial container made of flexible fabric that is designed for storing and transporting dry, flowable products. Bulk bags, such as bulk bag 20, may be made of thick woven polyethylene or polypropylene, either coated or uncoated, porous or non-porous, and normally measure between 32-48 inches in length, width or diameter and vary in height from 32 to 80 inches. Some bulk bags can expand to a larger dimension when filled. These bulk bags have a capacity that is normally around 2000 lbs., but depending upon their construction and the desired material to be contained, some units can store even more. Bulk bags are often made with either one, two or four lifting loops 22. Transporting and loading of filled bulk bags may be done by placing the bulk bag 20 on a pallet 26 (such as a standard 48"×40" pallet) and/or by lifting it from the attached lifting loops 22. Emptying is made easy by a special opening (not shown) in the bottom such as a discharge spout, of which there are several options, or by simply cutting it open. While the filling of a bulk bag 20 is shown herein, the use of other large scale industrial containers within bag placer assembly 200 is contemplated and desired to be protected.

According to the illustrated embodiment, bag placer assembly 200 includes two sections, namely base portion 210 and movable portion 250. Base portion 210 includes an outer housing 212 which is sized so as to at least partially contain a filled bulk bag 20. In the illustrated form, outer housing 212 includes top portions 212*a*, bottom portions 212*b* and three sidewalls 212*c*. In one form, outer housing 212 is formed from a strong and rigid material such as steel. Further, the base portion 210 includes a reinforcing frame 214 so as to maintain its shape despite having a vacuum or elevated pressure applied therein. A seal 216 surround the open portions of outer housing 212 which, when in contact with the matching portion of movable portion 250 creates a sealed vacuum/pressure chamber 202. Outer housing 212 may be in the form of a partial circle, square, octagon, hexagon, or some other desired shape. In the illustrated form, base portion 210 also includes guide tracks 218 which provide a path along which moveable portion 250 may travel.

Base portion 210 also includes a filler head 240 which is operable to establish an air-tight seal with the interior of bulk bag 20 as will be described later. In one form, filler head 240 is pivotally mounted to base portion 210 so as to be lifted out of the way during loading and removal of a bulk bag 20 (i.e. when moveable portion 250 is extended away from base portion 210) but lowered into place onto the top of bulk bag 20 during filling. In a further form, filler head 240 is actuated between these two positions (and may be held in place) by a linear actuator 242 or some other suitable mechanism. Filler head 240 is also in fluid communication with material supply line 126. Filler head 240 may also be in fluid communication with vacuum source 122 and/or a pressurized air source to enable the control of the pressure within the bulk bag 20 at various stages of the bag filling process. Additionally, in one form, filler head 240 includes sensors, such as a temperature sensor, a pressure sensor, and a humidity sensor (hidden from view) for providing real-time feedback to vacuum filling unit 100 via feedback lines (not shown).

Moveable portion 250 includes an outer housing 252 which is shaped so as to mate with outer housing 212 to fully enclose vacuum/pressure chamber 202. Outer housing 252 is sized so as to at least partially contain a filled bulk bag 20. In various forms, the outer housing 252 of moveable portion 250 forms half of the exterior of vacuum/pressure chamber 202. In various other forms, the outer housing 252 of moveable portion 250 forms less than half of the exterior of vacuum/pressure chamber 202. In certain forms, the outer housing 252 of moveable portion 250 has a distal size 254 along distal sidewall 252*c* which is greater than the width of bulk bag 20 and has a proximal size 255, at least along the top 252*a*, which is less than the width of bulk bag 20. In one further form, the outer housing 212 has a width that is greater than distal size 254. This relationship between distal size 254 and proximal size 255 and the size of outer housing 212 enables the moveable portion 250 to be easily slid away from base portion 210 despite the bulk bag 20 (contained therein) being filled to its maximum capacity.

In the illustrated form, outer housing 252 is in the shape of a wedge and includes a top portion 252*a*, a bottom portion 252*b* and a sidewall 252*c*. As with outer housing 212, outer housing 252 may similarly be formed from a strong and rigid material such as steel. Further, the moveable portion 250 includes a reinforcing frame 256 so as to maintain the shape of outer housing 252 despite having a vacuum or elevated pressure applied therein. Reinforcing frame 256 may also provide support for the bulk bag 20 during filling. For example, reinforcing frame may include one or more hooks/clamps 258 which can be used to manually (or with a power-assist) connect to lifting loops 22 so as to provide either partial or full support for bulk bag 20. In the illustrated form, top portion 252*a* includes an opening 260 which is surrounded by a collar 262 to which the opening bulk bag 20 may be securely mounted. Also in the illustrated form, wheels (not shown) are mounted to the underside of bottom portion 252*b* to enable the moveable portion 250 to move relative to base portion 200, such as by rolling on guide tracks 218.

As will be appreciated by one of skill in the art, moveable portion 250 may work in conjunction with seal 216 to provide an air-tight seal for the vacuum/pressure chamber 202 formed when base portion 210 and moveable portion 250 are positioned together. In alternative forms, seal 216 may be placed, in whole or in part, on the moveable portion 250 as opposed to base portion 210. In another form, both portions may include cooperative elements which work together to provide the desired seal. In addition, bag placer portion 200 may include latches, clamps or some other mechanism to ensure that base portion 210 and moveable portion 250 remain in proper position with one another during use, particularly when an elevated pressure is desired within vacuum/pressure chamber 202. Outer housing 212 may be in the form of a partial circle, square, octagon, hexagon, or some other desired shape. In the illustrated form, base portion 210 also includes guide tracks 218 which provide a path along which moveable portion 250 may travel.

In one form, bag placer assembly 200 also includes one or more scales or load cells (not shown) which are utilized to determine when the bulk bag 20 has been properly filled with the desired weight of material. In the illustrated form, one or more load cells are mounted to the base portion 210 such that they support the weight of the moveable portion 250 such that the increased weight of that portion may be determined during the filling operation. In an alternate form, one or more load cells are mounted beneath the moveable portion 250 such that the increased weight of that portion may be determined during the filling operation. In other forms, the bulk bag may be fully suspended so that one or more load cells may be placed in line with the straps 22 from which the bulk bag 20 hangs.

In alternative or additional forms, the bulk bag 20 may be placed upon a pallet 26 or other support structure to facilitate its removal once filled. This is advantageous as an empty bulk bag 20 can weigh as little as five pounds, but the same bag can weigh two-thousand pounds or more when filled. When the bulk bag is placed onto a support structure prior to being filled, the unique extension and wedge shape of moveable portion enables a forklift or other suitable machinery to easily access the pallet or support structure to remove the bulk bag 20. In an alternate form, the apparatus 10 may include a plurality of moveable portions, such as moveable portion 250, which are each rotated in sequentially, such as on a track or carousel, to sequentially or selectively combine with vacuum filling unit 100 so as to increase the throughput of the apparatus 10 by minimizing the downtime resulting from bulk bag placement and/or removal. Each moveable portion in such a series may be an individual unit, or may be a part of a chain or conveyor system.

Figure 4A:
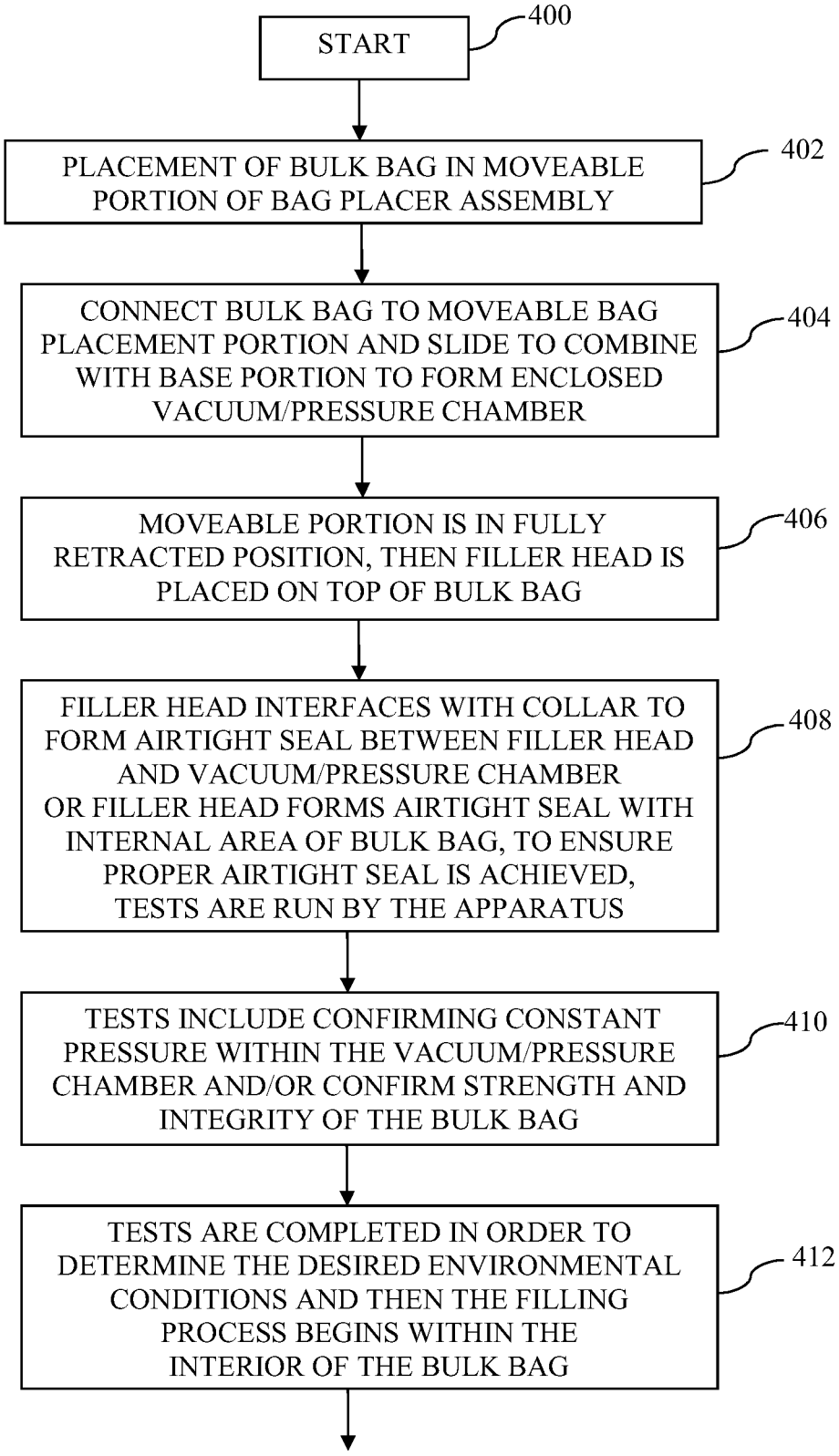
FIG. 4 is a flow chart showing one set of steps utilized in an embodiment of the present disclosure for filling a bulk container with material using the bulk container vacuum filling apparatus of FIG. 1.
Figure 4B:
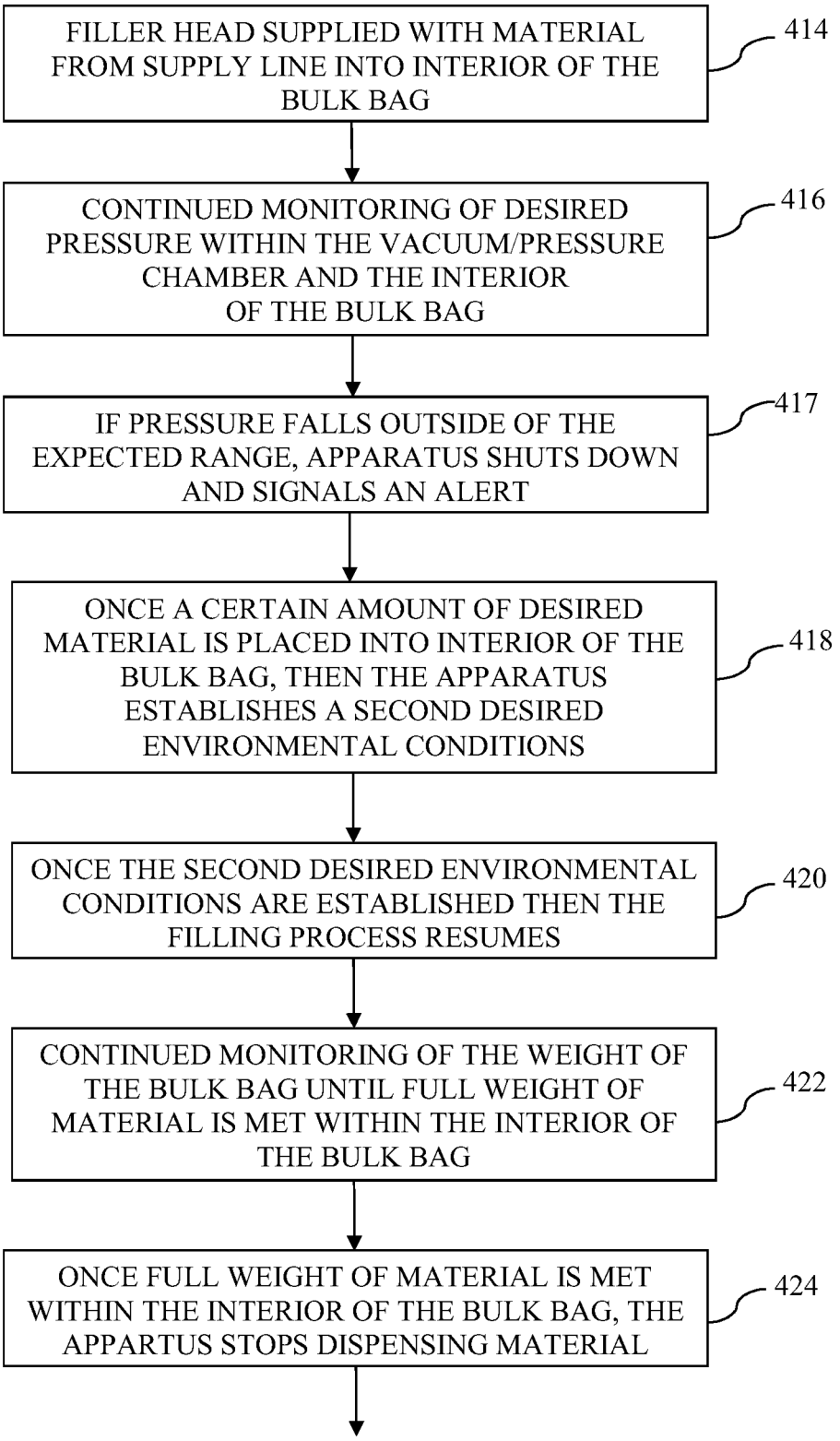
Figure 4C:
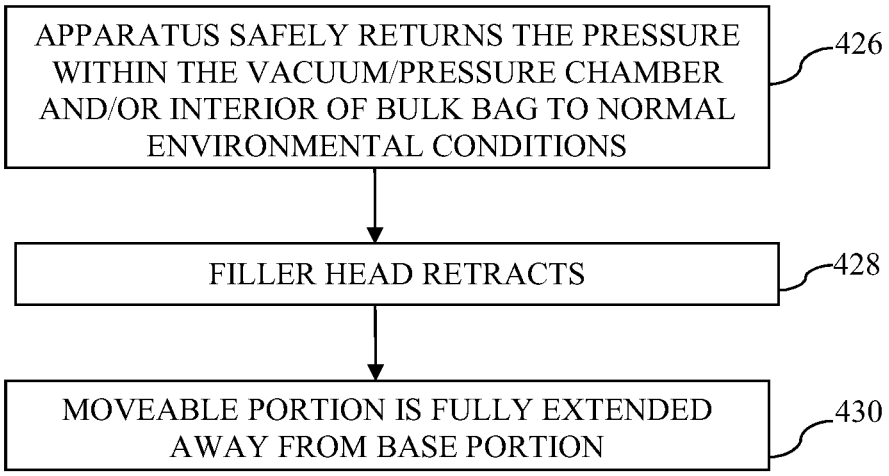

Once properly installed and connected to the required inputs, the operation of the apparatus 10, according to one form, is illustrated in FIG. 4. The process 400 begins at start with the placement of a bulk bag 20 within the moveable portion of bag placer assembly 200 (stage 402). The bulk bag 20 is connected to the bag placement portion, such as by manually connecting the loops 22 of bulk bag 20 to its support hooks/clamps 258 and the fill spout 23 through the opening 260 and to collar 262. Once the bulk bag 20 is properly connected, the moveable portion 250 slides along guide tracks 218, which may occur manually or by automation (using a winch or the like), in order to combine with base portion 210 to form a fully enclosed vacuum/pressure chamber 202 (stage 404). Once the moveable portion 250 is in its fully retracted position, the filler head 240 is moved into place on top of the bulk bag 20 (stage 406). The filler head 240 interfaces with collar 262 to establish an airtight seal between the filler head 240 and the vacuum/pressure chamber 202. In the case of an impermeable bulk bag 20, the filler head 240 may also establish an airtight seal with the internal area of bulk bag 20. In order to ensure that the proper airtight seal has been achieved, and to avoid the potential mess that can occur if not, the apparatus 10, as controlled by the vacuum filling unit 100, performs a series of tests to confirm that vacuum/pressure chamber 202 is properly sealed (stage 408). These tests may include repeatedly pressurizing and/or drawing a vacuum within the vacuum/pressure chamber 202 and subsequently confirming that the pressure remains constant over a selected period of time. Alternatively or additionally, apparatus 10 may also perform a similar test within bulk bag 20 so as to confirm both the strength and integrity of the bag (stage 410). In another form, apparatus 10 may establish one pressure within vacuum/pressure chamber 202 and a different pressure within the interior of bulk bag 20 (such as applying an elevated pressure within the interior of the bulk bag and drawing a vacuum within the vacuum/pressure chamber 202). Measuring these two differing pressures and their persistence can indicate any potential problems. These types of testing, either alone or in combination, can avoid the messy situation where material is filled into a torn or defective container.

Once these preliminary tests have been satisfactorily completed, the actual filling process commences with the apparatus 10 establishing the desired environmental conditions within the vacuum/pressure chamber 202 and/or the interior of the bulk bag 20 (stage 412). The desired conditions may vary significantly depending upon the type of material which is selected for placement within the bulk bag 20 or other container. For example, when filling with less dense materials the apparatus 10 may establish a lower pressure within the vacuum/pressure chamber 202 relative to that in the interior of the bulk bag 20 so as to inflate the bulk bag 20. This may include the use of either an elevated pressure or a partial vacuum, so long as the desired ratio is maintained. Alternatively, for more dense products, the apparatus 10 may establish a higher pressure within the vacuum/pressure chamber 202 relative to that in the interior of the bulk bag 20 so as to allow the material to slowly expand the bulk bag 20 to create a bellow type effect which will enable material to be drawn into the bulk bag 20 quicker. Once the initial environmental conditions are established, the filler head 240 being supplied material from the material supply line 126 into the interior of bulk bag 20 (stage 414).

In a further form, periodically throughout at least a portion of the remaining process the apparatus 10 monitors the desired pressure within each of the vacuum/pressure chamber 202 and the interior of the bulk bag 20 (stage 416). In the event either of these pressures is outside of the expected range, the apparatus 10 shuts down and signals an alert (stage 417).

Once a certain amount of the desired material has been placed into the bulk bag 20 (as determined by differential weights provided by the scales or load cells), or after a set period of time, the apparatus 10 establishes a second desired environmental condition within the vacuum/pressure chamber 202 and/or the interior of the bulk bag 20 (stage 418). The second desired conditions vary from the initial conditions under which filling began may also vary depending upon the type of material which is selected for placement within the bulk bag 20 or other container. For example, for less dense products the apparatus 10 may utilize may periodically provide an elevated pressure, either within the vacuum/pressure chamber 202 and/or the interior of the bulk bag 20 to enhance compaction of the material. Alternatively, for more dense products, this process may not be needed when filling denser materials which provide adequate packing on their own and as such a vacuum may be maintained within the vacuum pressure chamber 202 throughout the process. Once the second environmental conditions are established, the filler head 240 resumes supplying material from the material supply line 126 into the interior of bulk bag 20 (stage 420). In some forms, the filler head 240 is controlled so as to supply material at a second flow rate, which may be higher or lower than the initial flow rate, so as to more efficiently fill the bulk bag 20.

Once the process reaches a certain point, the apparatus 10 continuously monitors the weight of the bulk bag 20 and its contents (as determined by differential weights provided by the scales or load cells) to determine when the full weight of material has been dispensed (stage 422). When this condition is met, the apparatus 10 stops dispensing material (stage 424). With the bag now full, the apparatus 10 safely returns the pressure within the vacuum/pressure chamber 202 and/or the interior of bulk bag 20 to normal environmental conditions (stage 426). The filler head 240 then retracts (stage 428) and the moveable portion 250 slides along guide tracks 218, which may occur manually or by automation (using a winch or the like), to its fully extended position away from base portion 210 (stage 430). This enables the bulk bag 20 to be removed therefrom, such as by using a forklift, skid steer or the like, or for the moveable portion 250 to be moved away so as to make room for the next moveable portion 250 to take its place in a serial filling process.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A vacuum filling machine (10) for packing a finely divided particulate material into a bulk bag (20) having a filling spout (23), the machine comprising:

a vacuum chamber (202) formed from a first portion (210) and a second portion (250) connected to and moveable relative to one another, wherein said first portion (210) forms two lateral sidewalls and a proximal sidewall (212) of said vacuum chamber (202) and;

a vacuum source (122) for drawing a vacuum within the vacuum chamber (202);

a support framework (256) at least partially within the second portion (252), including at least two attachment means (258) for supporting a plurality of hanging loops (22) of the bulk bag (20);

an opening (260) in the second portion (250) of the vacuum chamber (202) for receiving the filling spout (23) of the bulk bag (20);

a bag filling head (240) in fluid communication with a material supply line (126) for providing the particulate material, the bag filling head (240) configured to cover and seal the opening (260);

wherein the second portion (250) includes a distal sidewall (252*c*) relative to the first portion (210), at least a portion of a top wall (252*a*) including the opening (26) and no portion of lateral sidewalls (212) such that when extended away from the first portion (210) unrestricted access is provided to the bulk bag (20) from both sides along the entire height of the bulk bag when filled to facilitate removal of the bulk bag.

2. The machine of claim 1, wherein the first portion (210) of the vacuum chamber (202) is stationary and the second portion (250) is slideably connected to the first portion (210).

3. The machine of claim 2, further comprising a set of guide tracks (218) upon which the second portion (250) may slide away from the first portion (210).

4. The machine of claim 1, wherein the second portion (250) includes at least four attachment means (258) for hanging the bulk bag (20) within the vacuum chamber.

5. The machine of claim 1, wherein the bulk bag (20) is a flexible intermediate bulk container.

6. The machine of claim 5, wherein the bulk bag is between 32 inches and 48 inches in length and width and between 32 inches and 80 inches in height when fully expanded, but not stretched.

7. The machine of claim 6, wherein a floor (212*b*) of the vacuum chamber is sized so as to receive a standard sized 48"×40" pallet (26).

8. The machine of claim 7, wherein the top wall (252*a*) has a non-rectangular shape.

9. The machine of claim 8, wherein the top wall (252*a*) is in the form of a wedge.

10. The machine of claim 1, further comprising a pressure source for creating positive pressure within the vacuum chamber (202).

* * * * *